US009936281B2

(12) United States Patent
Tamura et al.

(10) Patent No.: US 9,936,281 B2
(45) Date of Patent: Apr. 3, 2018

(54) HEADPHONE

(71) Applicant: Panasonic Intellectual Property Management Co., Ltd., Osaka (JP)

(72) Inventors: Kazuo Tamura, Osaka (JP); Masahiro Nakano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/306,070

(22) PCT Filed: Dec. 8, 2015

(86) PCT No.: PCT/JP2015/006090
§ 371 (c)(1),
(2) Date: Oct. 21, 2016

(87) PCT Pub. No.: WO2016/092817
PCT Pub. Date: Jun. 16, 2016

(65) Prior Publication Data

US 2017/0064436 A1 Mar. 2, 2017

(30) Foreign Application Priority Data

Dec. 9, 2014 (JP) ..... 2014-249286

(51) Int. Cl.
*H04R 25/00* (2006.01)
*H04R 1/10* (2006.01)
(Continued)

(52) U.S. Cl.
CPC ..... *H04R 1/1066* (2013.01); *H04R 1/26* (2013.01); *H04R 1/1008* (2013.01);
(Continued)

(58) Field of Classification Search
CPC ..... H04R 1/1066; H04R 1/26; H04R 5/0335; H04R 1/1091; H04R 1/1008; H04R 1/1075
(Continued)

(56) References Cited

U.S. PATENT DOCUMENTS 9,392,354 B2 * 7/2016 Willberg ..... H04R 5/033
2005/0238189 A1 * 10/2005 Tsai ..... H04R 1/1075 381/370
2014/0016812 A1 1/2014 Willberg

FOREIGN PATENT DOCUMENTS

JP 63-268395 11/1988
JP 2013-199187 10/2013
(Continued)

OTHER PUBLICATIONS

International Search Report of PCT application No. PCT/JP2015/006090 dated Jan. 12, 2016.
(Continued)

*Primary Examiner* — Brian Ensey
(74) *Attorney, Agent, or Firm* — McDermott Will & Emery LLP

(57) ABSTRACT

A headphone includes a speaker casing and a headband. The speaker casing has a main speaker unit and a support member that supports the main speaker unit. The speaker casing is connected to the headband, and the headband is to be placed on a head of a user. The support member supports the main speaker unit with a main plane of the main speaker unit being positioned at an angle ranging from 10° to 30° inclusive with respect to a main plane of the support member, so that the main plane of the main speaker unit faces a side of an ear lobe of the user.

7 Claims, 9 Drawing Sheets

(51) Int. Cl.
*H04R 1/26* (2006.01)
*H04R 5/033* (2006.01)

(52) U.S. Cl.
CPC ..... *H04R 1/1075* (2013.01); *H04R 1/1091* (2013.01); *H04R 5/0335* (2013.01)

(58) Field of Classification Search
USPC ..... 381/370, 371, 372, 373
See application file for complete search history.

(56) References Cited

FOREIGN PATENT DOCUMENTS

| | | |
|---|---|---|
| JP | 2014-512751 | 5/2014 |
| WO | 2013/005775 | 1/2013 |

OTHER PUBLICATIONS

Kazuhiro Iida,"Sound field reproduction by transaural system with two loudspeakers", The Journal of the Acoustical Society of Japan, vol. 67, No. 11, pp. 550-555, Nov. 1, 2011.

* cited by examiner

HEADPHONE

CROSS-REFERENCE TO RELATED APPLICATIONS

This application is a U.S. national stage application of the PCT International Application No. PCT/JP2015/006090 filed on Dec. 8, 2015, which claims the benefit of foreign priority of Japanese patent application No. 2014-249286 filed on Dec. 9, 2014, the contents all of which are incorporated herein by reference.

TECHNICAL FIELD

The present disclosure relates to headphones.

BACKGROUND ART

A headphone is an exemplary piece of audio equipment. A headphone is used by being connected to an apparatus having an audio signal output function (an audio signal reproducing apparatus) such as an audio player, a television receiver (abbreviated below as a TV), or the like.

A typical headphone includes two speaker casings for the user's right ear and the user's left ear, and a headband to be placed on the top of the head of the user. Each of the speaker casings includes a main speaker unit that outputs sound and a support member that supports the main speaker unit. The main speaker unit includes a diaphragm, a voice coil, and the like. The headband includes an elongated, curved member. Both ends of the headband are connected to the two speaker casings, respectively.

NPL 1 discloses a technique for improving the sound quality of a speaker system having two speakers.

When audio equipment reproduces music, a movie, or a concert program, for example, a user expects that high-quality sound comes out.

Therefore, it is demanded that headphones output high-quality sound.

CITATION LIST

Non-Patent Literature

NPL 1: "Sound field reproduction by transaural system with two loudspeakers" written by Kazuhiro Iida, the journal of the Acoustical Society of Japan, 2011, Vol. 67, No. 11.

SUMMARY

The present disclosure provides a headphone that can improve quality of sound heard by a user wearing the headphone.

According to the present disclosure, a headphone includes a speaker casing and a headband. The speaker casing has a main speaker unit and a support member that supports the main speaker unit. The headband is connected to the speaker casing and is to be placed on the head of a user. The support member supports the main speaker unit with a main plane of the main speaker unit being positioned at an angle ranging from 10° to 30° inclusive with respect to the main plane of the support member, so that the main plane of the main speaker unit faces an ear lobe of the user.

According to the present disclosure, a headphone includes a speaker casing and a headband. The speaker casing has a main speaker unit and a support member that supports the main speaker unit. The headband is connected to the speaker casing and is to be placed on the head of a user. In the headphone, two points estimated to be locations of two tympanic membranes of the user are set as two reference points, and an axis connecting the two reference points is set as a first axis. An axis that passes through the reference point, is perpendicular to the first axis, and is parallel to a front-back direction of the head of the user is set as a second axis. The support member supports the main speaker unit so as to be rotated around the second axis in a direction from the first axis to a top of the head of the user, so that a main axis of the main speaker unit passes through the reference point and is inclined at an angle ranging from 10° to 30° inclusive with respect to the first axis.

The headphone according to the present disclosure can improve quality of sound heard by a user wearing the headphone.

DESCRIPTION OF EMBODIMENTS

<Basic Findings for the Present Disclosure>

Figure 1:
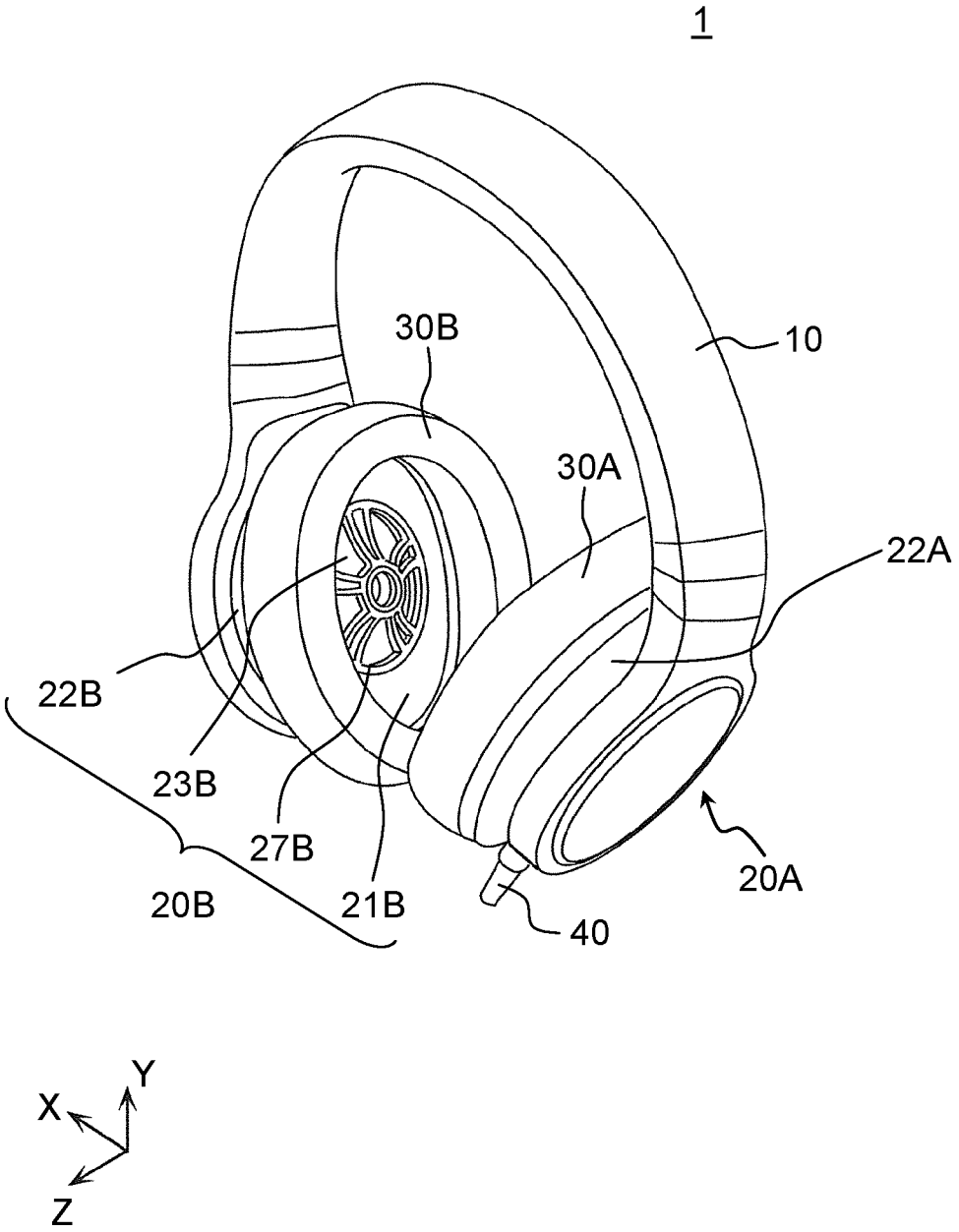
FIG. 1 is a perspective view schematically illustrating an exemplary appearance of a headphone in a first exemplary embodiment.

A conventional common knowledge will be described below. Two points estimated to be the locations of two tympanic membranes of a user are set as two reference points. Then, the axis connecting the two reference points is set as a first axis. Speakers are placed such that the main axis of main speaker units is positioned in a horizontal plane containing the first axis. Placing the speakers in this manner is thought to improve quality of sound heard by a user.

In NPL 1 described above, a study is conducted to examine whether or not there are any other advantageous locations at which speakers output higher quality sound, other than the horizontal plane containing the first axis. In examination for this study, average location errors are measured in travel directions of sound. The term "average location error" discussed herein refers to the difference (error) in direction between a sound source recognized by a subject and an actual sound source. Normally, if the average location error decreases, a listener feels that the sound image becomes clearer and thus the presence of the sound is improved.

In this examination, the subject's head is fixed such that the axis connecting the top of the head to the chin extends in a vertical direction (in the direction of gravitational force). Then, a sound source is moved in the vertical plane containing the first axis while emitting sound. Simultaneously, average location errors are measured.

The study demonstrates that, in the speaker systems having two speakers, quality of sound (enhanced presence) heard by a user can be improved by adjusting vertical locations of the speakers based on the experimental result.

As described above, it is also demanded that headphones output high-quality sound. It is, however, difficult to change locations of the speaker casings relative to user's ears, because when a user wears a headphone, the ear pads of the speaker casings are in contact with parts of a user's body around the ears.

When a user wears a headphone, his/her tympanic membranes are approximately 30 mm (average) away from the main planes of the speaker casings of the headphone in a direction along the first axis; the main planes correspond to planes created by parts of the housings to which the ear pads are attached. Further, the inventors of the present disclosure have found the fact that adjusting an angle of the diaphragms with respect to the tympanic membranes can produce substantially the same effect as the case where the locations of speakers are changed.

Hereinafter, exemplary embodiments will be described in detail with reference to the accompanying drawings as appropriate. However, an unnecessarily detailed description will not be provided. For example, a detailed description of a well-known matter and a redundant description on substantially the same configuration will not be provided. This is to prevent the following description from being unnecessarily redundant, so as to facilitate understanding of those skilled in the art.

The accompanying drawings and the following descriptions are provided for those skilled in the art to fully understand the present disclosure, and it is not intended to limit the subject matter described in the claims by the accompanying drawings and the following descriptions.

The accompanying drawings are schematic only, and do not necessarily reflect the actual scales. In the accompanying drawings, identical reference marks are given to substantially the same constituent elements.

First Exemplary Embodiment

A first exemplary embodiment will be described below with reference to FIG. 1 to FIG. 8. In this exemplary embodiment, the angle of the diaphragms mounted in the speaker casings is adjusted based on the foregoing findings.

[1. Configuration of Headphone]

FIG. 1 is a perspective view schematically illustrating an exemplary appearance of headphone 1 in the first exemplary embodiment.

Figure 2:
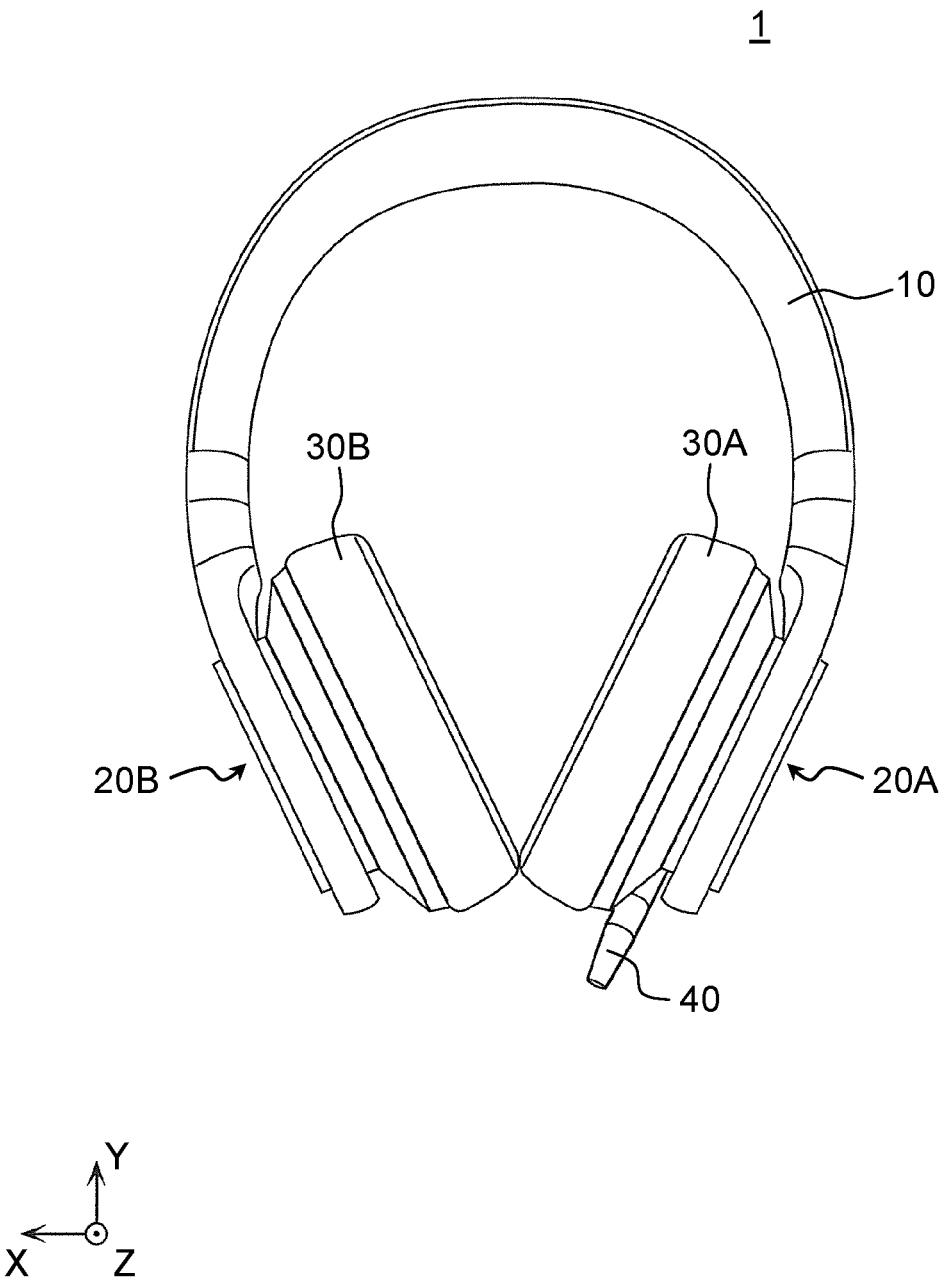
FIG. 2 is a front elevation view schematically illustrating an exemplary appearance of the headphone in the first exemplary embodiment.

FIG. 2 is a front elevation view schematically illustrating an exemplary appearance of headphone 1 in the first exemplary embodiment.

Figure 3:
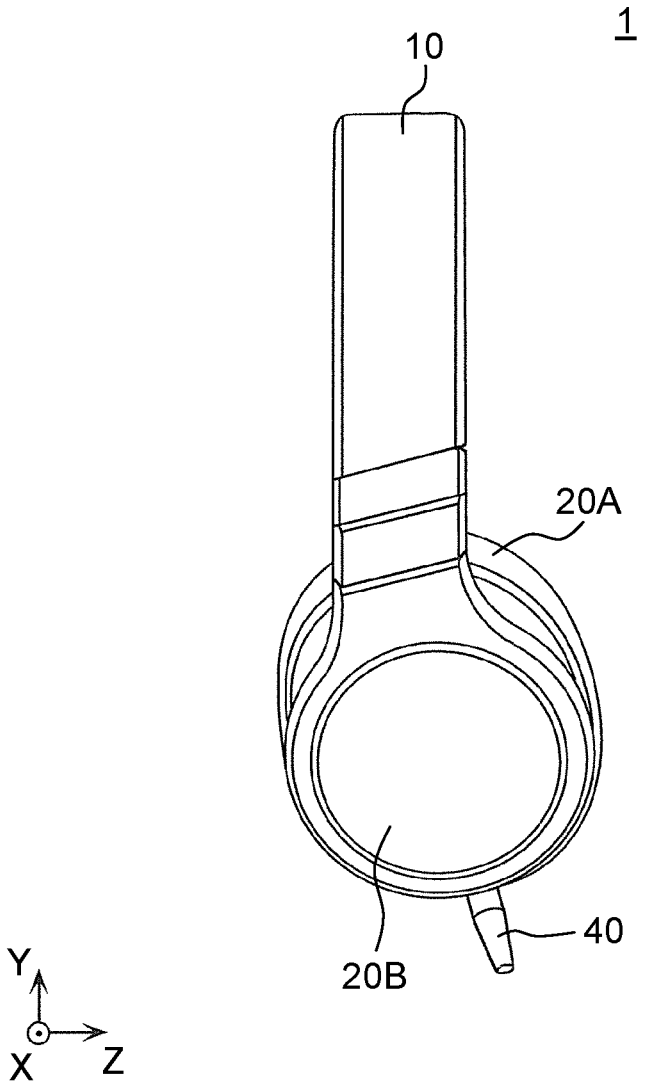
FIG. 3 is a side elevation view schematically illustrating an exemplary appearance of the headphone in the first exemplary embodiment.

FIG. 3 is a side elevation view schematically illustrating an exemplary appearance of headphone 1 in the first exemplary embodiment. More specifically, FIG. 3 illustrates a side of headphone 1 as viewed from speaker casing 20B for a right ear.

Figure 4:
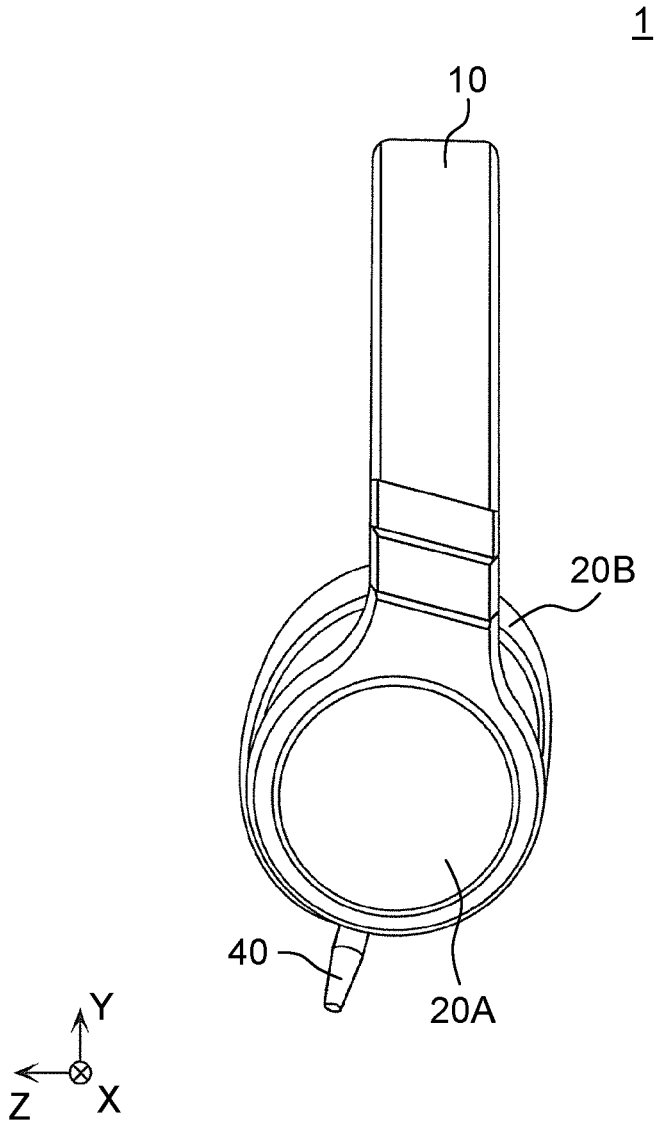
FIG. 4 is a side elevation view schematically illustrating an exemplary appearance of the headphone in the first exemplary embodiment.

FIG. 4 is a side elevation view schematically illustrating an exemplary appearance of headphone 1 in the first exemplary embodiment. More specifically, FIG. 4 illustrates a side of headphone 1 as viewed from speaker casing 20A for a left ear.

As an example illustrated in FIG. 1 to FIG. 4, headphone 1 includes headband 10, speaker casing 20A for a left ear, and speaker casing 20B for a right ear.

[1-1. Configuration of Headband]

Headband 10 is a member to be placed on a user's head.

Headband 10 has an elongated member that is formed into a curved shape so that a person can wear it on his/her head. One end of the elongated member is connected to speaker casing 20A, which is in contact with the user's left ear when the user wears headphone 1. Hereinafter, a user who wears headphone 1 is also referred to below as simply a "user". The other end of the elongated member is connected to speaker casing 20B, which is in contact with the user's right ear when the user wears headphone 1.

Headband 10 may further include: a head pad to be in contact with the top of the user's head; a microphone; and other members (not all illustrated). In this exemplary embodiment, speaker casing 20A is connected to the one end of the elongated member, whereas speaker casing 20B is connected to the other end of the elongated member. However, speaker casing 20A may be connected to a portion of the elongated member which is a predetermined distance away from the one end, whereas speaker casing 20B may be connected to a portion of the elongated member which is a predetermined distance away from the other end. Both speaker casing 20A and speaker casing 20B may be fixedly connected to the elongated member. Alternatively, the portions of the elongated member to which speaker casing 20A and speaker casing 20B are connected may be movable.

Figure 5:
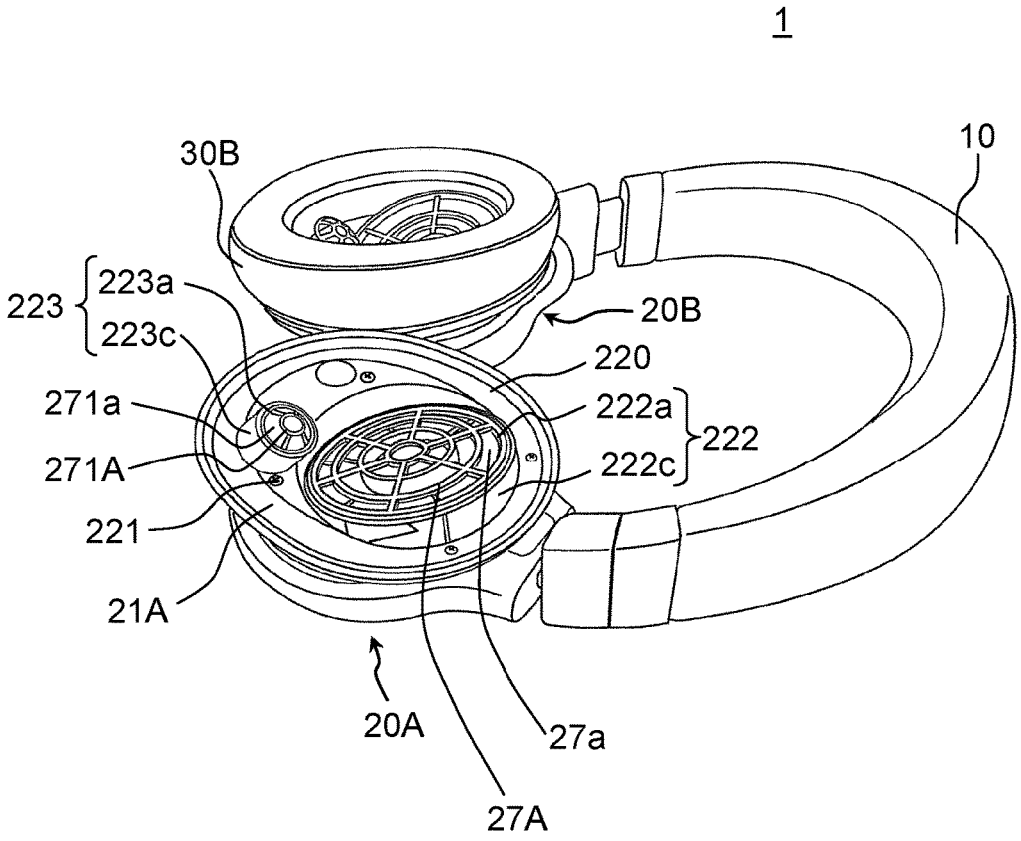
FIG. 5 is a perspective view schematically illustrating an exemplary configuration of the speaker casings in the first exemplary embodiment.

In this exemplary embodiment, the elongated member in headband 10 has a variable length (see FIG. 5). For individual users, generally, the sizes of the heads and the locations of the ears are different. So, since the length of headband 10 is adjustable, users can wear speaker casing 20A and speaker casing 20B over their ears by adjusting the length of headband 10. The configuration of adjusting the length of headband 10 can be accomplished with a mechanism typically used in the art. Thus, this configuration is not regarded as an essential configuration in the present disclosure.

Headband 10 further contains signal wires (not illustrated), in which audio signals travel from speaker casing 20A to speaker casing 20B.

[1-2. Configuration of Speaker Casing]

Details of speaker casing 20A and speaker casing 20B will be described below. In this exemplary embodiment, only speaker casing 20A in headphone 1 is provided with connector 40. Connector 40 is a member to which a cord (not illustrated) for transmitting audio signals is connected. Aside from connector 40, however, speaker casing 20A and speaker casing 20B have substantially the same configuration. Therefore, a description that will be given below is focused on speaker casing 20A, and details of speaker casing 20B will not be described.

Speaker casing 20A and speaker casing 20B are members that are in contact with the user's ears when the user wears headphone 1. Each of speaker casing 20A and speaker casing 20B contains a main speaker unit and a sub-speaker unit. Both of the main speaker unit and the sub-speaker unit reproduce sound in accordance with audio signals output from an audio signal reproducing apparatus (not illustrated). To transmit the audio signals from the audio signal reproducing apparatus to headphone 1, headphone 1 may be connected to the audio signal reproducing apparatus via the cord for transmitting audio signals (not illustrated) or may be wirelessly connected to the audio signal reproducing apparatus.

In this exemplary embodiment, speaker casing 20A is intended for the user's left ear, whereas speaker casing 20B is intended for the user's right ear. In short, headphone 1 is configured such that sound for the left ear is output from speaker casing 20A and sound for the right ear is output from speaker casing 20B. Therefore, when headphone 1 is placed on the user's head, speaker casing 20A covers the user's left ear and speaker casing 20B covers the user's right ear. This state is normally maintained when headphone 1 is used.

FIG. 5 is a perspective view schematically illustrating an exemplary configuration of speaker casing 20A in the first exemplary embodiment. In headphone 1, both speaker casing 20A and speaker casing 20B are rotatable relative to headband 10. In FIG. 5, both speaker casing 20A and speaker casing 20B are rotated relative to headband 10.

Figure 6A:
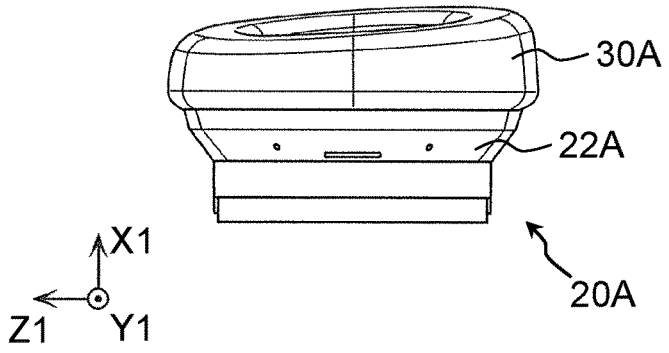
FIG. 6A is a side elevation view schematically illustrating an exemplary configuration of one speaker casing in the first exemplary embodiment.
Figure 6B:
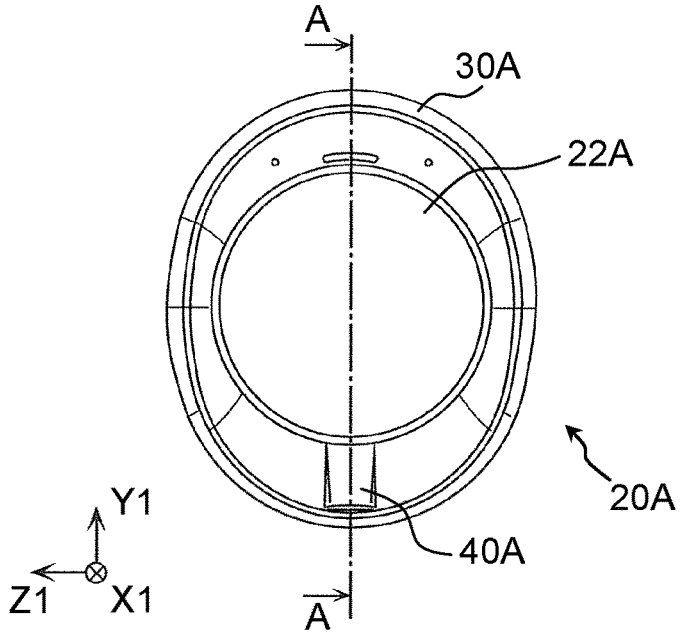
FIG. 6B is a back elevation view schematically illustrating an exemplary configuration of the speaker casing in the first exemplary embodiment.
Figure 6C:
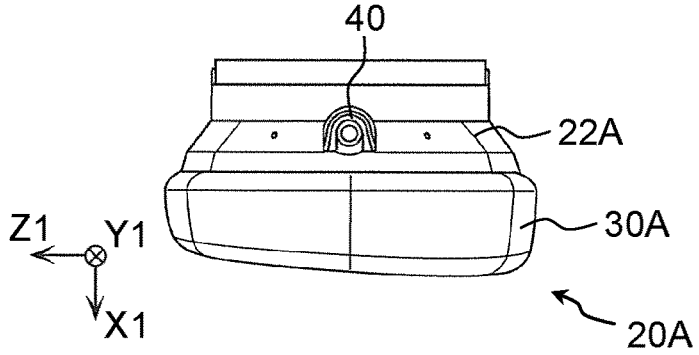
FIG. 6C is a side elevation view schematically illustrating an exemplary configuration of the speaker casing in the first exemplary embodiment.
Figure 6D:
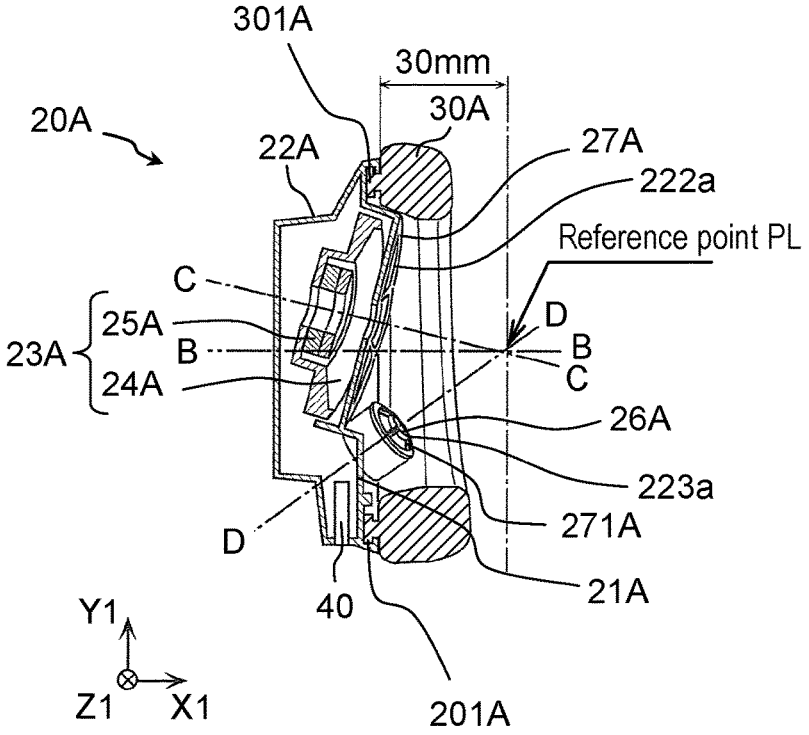
FIG. 6D is a cross-sectional view schematically illustrating an exemplary configuration of the speaker casing in the first exemplary embodiment.
Figure 6E:
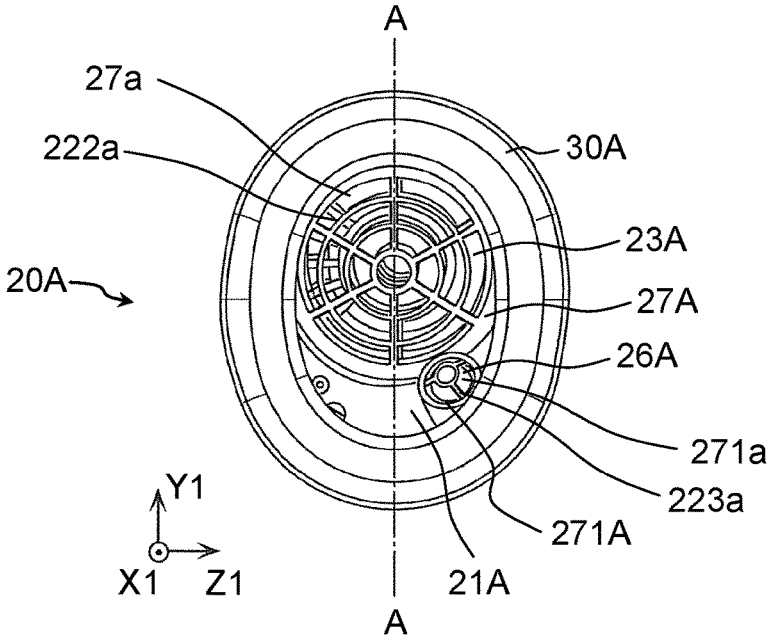
FIG. 6E is a front elevation view schematically illustrating an exemplary configuration of the speaker casing in the first exemplary embodiment.

FIG. 6A is a side elevation view schematically illustrating an exemplary configuration of speaker casing 20A in the first exemplary embodiment. FIG. 6B is a back elevation view schematically illustrating an exemplary configuration of speaker casing 20A in the first exemplary embodiment. FIG. 6C is a side elevation view schematically illustrating an exemplary configuration of speaker casing 20A in the first exemplary embodiment. FIG. 6D is a cross-sectional view schematically illustrating an exemplary configuration of speaker casing 20A in the first exemplary embodiment. FIG. 6E is a front elevation view schematically illustrating an exemplary configuration of speaker casing 20A in the first exemplary embodiment. The cross section in FIG. 6D is taken along the line A-A in FIG. 6B. In the description that will be given below with reference to FIG. 6A to FIG. 6E, the side of speaker casing 20A which is to be in contact with the user's ear is referred to as the front surface, the surface of speaker casing 20A opposite to the front surface is referred to as the back surface, and the surface of speaker casing 20A between the front surface and the back surface (which is substantially perpendicular to both the front surface and the back surface) is referred to as the side surface.

In the description that will be given below, axis X1, axis Y1, and axis Z1 are defined as follows, for the sake of expediency.

Axis X1 is parallel to first axis B (see FIG. 6D) that connects two points (two reference points) estimated to be the locations of two tympanic membranes of the user. In FIG. 6D, only the reference point of the left ear is illustrated. In other words, axis X1 is substantially parallel to a lateral direction of the user's head, or an axis connecting the right ear and the left ear, when the user wears headphone 1.

Axis Y1 is substantially parallel to a longitudinal direction of the user's pinna. More specifically, axis Y1 is perpendicular to axis X1 and substantially parallel to a longitudinal direction of the user's head (the axis connecting the chin and the top of the head) when the user wears headphone 1. In other words, axis Y1 is perpendicular to axis X1 and substantially parallel to the axis connecting the tragus and ear lobe.

Axis Z1 is orthogonal to both axis X1 and axis Y1. More specifically, axis Z1 is substantially parallel to a front-back direction of the user's head when the user wears headphone 1.

Speaker casing 20A includes: main speaker unit 23A that outputs sound; and a support member that supports main speaker unit 23A.

More specifically, as an example illustrated in FIG. 6A to FIG. 6E, speaker casing 20A includes ear pad 30A, housing 22A, baffle plate 21A, which is an example of the support member, protector 27A, main speaker unit 23A, protector 271A, sub-speaker unit 26A, and connector 40.

As illustrated in FIG. 1, speaker casing 20B includes ear pad 30B, housing 22B, baffle plate 21B, which is an example of the support member, protector 27B, main speaker unit 23B, protector 271B (not illustrated; only the reference mark is assigned), and sub-speaker unit 26B (not illustrated; only the reference mark is assigned). The configuration of speaker casing 20B is substantially the same as that of speaker casing 20A, aside from connector 40.

[1-2-1. Ear Pad]

Ear pad 30A is a member that covers the user's ear when the user wears headphone 1. As an example illustrated in FIG. 6A to FIG. 6E, ear pad 30A is formed into a torus (annular) shape so as to cover (the side surface of) the ear.

In this exemplary embodiment, as an example illustrated in FIG. 6D, ear pad 30A is detachable from baffle plate 21A. The side of ear pad 30A which is in contact with baffle plate 21A is provided with engaging section 301A, which fits into groove 201A formed on the outer circumference of baffle plate 21A. Detailed configurations of housing 22A, baffle plate 21A, protector 27A, and protector 271A will be described later.

By fitting engaging section 301A into groove 201A in baffle plate 21A, ear pad 30A can be attached to the outer circumference of baffle plate 21A. This configuration enables the user's ear to be accommodated in the space surrounded by ear pad 30A, baffle plate 21A, and protector 27A and protector 271A that cover openings of baffle plate 21A. Ear pad 30A may be fixed to baffle plate 21A.

As an example illustrated in FIG. 6D, the cross-sectional area of ear pad 30A in a radial direction increases toward the ear lobe. In other words, the cross-sectional area of ear pad 30A in a radial direction decreases toward the top of the head. In general, the width of a human head tends to gradually decrease from the side portion to the chin. Thus, the above configuration can keep the main plane of baffle plate 21A (the main plane of protector 27A) nearly perpendicular to the first axis B.

Ear pad 30A may be made of a soft resin material and can be deformed in accordance with a shape of a part of the user's body around the ear. This enables ear pad 30A to be in better contact with both baffle plate 21A and the user's ear (the part surrounding the ear). Consequently, the foregoing space (the space surrounding the user's ear) can be made more closed space with a little gap (enclosed space).

[1-2-2. Housing]

Housing 22A and baffle plate 21A, are examples of the support member, support main speaker unit 23A with a state where main speaker unit 23A is accommodated in the space that is made of both housing 22A and baffle plate 21A.

Housing 22A is connected to headband 10. As an example illustrated in FIG. 6A to FIG. 6E, housing 22A is a member that has a recess in which an oval or elliptical opening is formed.

[1-2-2-1. Main Speaker Container]

As an example illustrated in FIG. 6D, main speaker unit container 222 is an internal space created between baffle plate 21A and housing 22A, and is also a region behind protector 27A, where main speaker unit 23A is disposed. The opening of baffle plate 21A in which main speaker unit container 222 is created is formed within a region that contains the center of baffle plate 21A and is shifted to the top of the user's head (when the user wears the headphone 1).

As an example illustrated in FIG. 5, main speaker unit container 222 is surrounded by flat part 220. Main speaker unit container 222 is formed such that a part of the main plane and side surface of main speaker unit 23A is accommodated in main speaker unit container 222. Therefore, the shape and size of main speaker unit container 222 depend on the shape and size of main speaker unit 23A. Main speaker unit container 222 partially protrudes from the surface of flat part 220 (the surface on the ear side) toward the user's ear.

Main speaker unit container 222 includes sound output section 222*a* which corresponds to the opening of baffle plate 21A, and slope 222*c*.

As an example illustrated in FIG. 6D, diaphragm 24A of main speaker unit 23A is disposed on the back surface of sound output section 222*a* (see FIG. 5). Protector 27A is disposed in the part of sound output section 222*a* of main speaker unit container 222.

Slope 222*c* is a cylindrical member that constitutes the side surface of sound output section 222*a*. When the user wears headphone 1, the height of slope 222*c* with respect to flat part 220 increases toward the top of the head. In other words, the height of slope 222*c* with respect to flat part 220 decreases away from the top of the head (or toward the ear lobe). Sound output section 222*a* that covers an upper part of slope 222*c* is inclined with respect to baffle plate 21A (flat part 220). This is for main speaker unit 23A to be angled with respect to first axis B, details of which will be described later.

As described above, main speaker unit 23A is partially covered with sound output section 222*a* and slope 222*c*.

[1-2-2-2. Sub-Speaker Container]

Sub-speaker unit container 223 is an internal space created between baffle plate 21A and housing 22A, and is also a region behind protector 271A, where sub-speaker unit 26A is disposed. Therefore, the shape and size of sub-speaker unit container 223 depend on the shape and size of sub-speaker unit 26A. As an example illustrated in FIG. 6E, the opening of baffle plate 21A, in which sub-speaker unit container 223 is created, is formed below main speaker unit 23A (close to the user's chin when the user wears headphone 1) and close to the front portion of the head with respect to the central line A (close to the user's face when the user wears headphone 1). Central line A is parallel to axis Y1 and passes through substantially the center of speaker casing 20A (or baffle plate 21A).

Sub-speaker unit container 223 includes sound output section 223*a* which corresponds to the opening of baffle plate 21A, and slope 223*c*.

A diaphragm (not illustrated) of sub-speaker unit 26A is disposed on the back surface of sound output section 223*a*. Protector 271A is disposed in a part of sound output section 223*a* of sub-speaker unit container 223.

Slope 223*c* is a cylindrical member that constitutes the side surface of sound output section 223*a*. When the user wears headphone 1, the height of slope 223*c* with respect to flat part 220 decreases toward the top of the head. In other words, the height of slope 223*c* with respect to flat part 220 increases away from the top of the head (or toward the ear lobe). Sound output section 223*a* that covers an upper part of slope 223*c* is inclined with respect to flat part 220. This is for sub-speaker unit 26A to be angled with respect to first axis B, as will be described later.

[1-2-3. Baffle Plate]

Baffle plate 21A is a member that is attached to housing 22A so as to cover the opening of housing 22A.

As an example illustrated in FIG. 5, baffle plate 21A includes flat part 220 and fixing sections 221. Baffle plate 21A is provided with two openings. It should be noted that in FIG. 5, ear pad 30A is removed from baffle plate 21A.

Flat part 220 is an oval, plate-like member whose outline substantially matches the opening of housing 22A. Flat part 220 is attached to the opening of housing 22A. In this exemplary embodiment, the surface of flat part 220 (which is exposed toward the ear) corresponds to the main plane of baffle plate 21A.

Flat part 220 is provided with two openings; one opening of the two openings is covered with protector 27A that protects main speaker unit 23A and the other opening of the two openings is covered with protector 271A that protects sub-speaker unit 26A. The one opening is an opening to which Main speaker unit 23A is attached, and the one opening is formed so that the center of main speaker unit 23A is positioned above first axis B (closer to the top of the user's head with respect to first axis B when the user wears headphone 1) (see FIG. 6D). The other opening is an opening to which Sub-speaker unit 26A is attached, and the other opening is formed so that the center of sub-speaker unit 26A is positioned below first axis B (closer to the user's chin with respect to first axis B when the user wears headphone 1) (see FIG. 6D). In this exemplary embodiment, baffle plate 21A and protector 271A are integrated with each other; however, baffle plate 21A and protector 271A may be independent members.

Fixing sections 221 are each provided with a hole through which a screw passes in order to fix baffle plate 21A to housing 22A. By passing the screws through these holes and baffle plate 21A being screwed onto housing 22A, baffle plate 21A is fixed to housing 22A.

As described above, baffle plate 21A has an outer circumference on which toric annular groove 201A is formed; groove 201A is used to attach ear pad 30A to baffle plate 21A.

The surface of baffle plate 21A which is defined by groove 201A or by the opening of housing 22A corresponds to the main plane of baffle plate 21A, namely, the main plane of the support member. The main plane of the support member may intersect at least a part of baffle plate 21A, and may be a surface that is perpendicular to first axis B or may be a surface that intersects first axis B at an angle of approximately perpendicularity.

Baffle plate 21A may be made of a material including a vibration-damping material, such as polylactic acid or polylactide (PLA).

[1-2-4. Protectors]

Protector 27A is a member that covers one of the two openings of baffle plate 21A. As an example illustrated in FIG. 6D, protector 27A is attached to the front surface of main speaker unit 23A (which is closer to the ear). As an example illustrated in FIG. 5, protector 27A is provided in sound output section 222*a* of main speaker unit container 222 which contains main speaker unit 23A. Protector 27A corresponds to protection member of main speaker unit 23A.

As examples illustrated in FIG. 5 and FIG. 6E, protector 27A is a circular member in which a plurality of slits 27*a* are formed. Protector 27A is formed so as to allow the surface of diaphragm 24A, which will be described later, to be viewed from the outside.

More specifically, protector 27A has a circular slit formed therein, six slits having substantially the same (sectoral) shape and formed in a first circle that surrounds the circular slit, six slits having substantially the same (sectoral) shape and formed in a second circle that is larger than the first circle, and six slits having substantially the same (sectoral) shape and formed in a third circle that is larger than the second circle. Hereinafter, these slits are collectively referred to as slits 27*a*. In short, protector 27A includes four torus plates having different sizes. These torus plates are disposed in substantially the same plane and interconnected via six elongated bridge parts extending in a radial direction. The six elongated bride parts are disposed at substantially regular angles. The size of protector 27A depends on the size of diaphragm 24A, which is a component of main speaker unit 23A.

In this exemplary embodiment, protector 271A is provided as a protector which covers the other of the two openings of baffle plate 21A. As an example illustrated in FIG. 6D, protector 271A is provided in sound output section 223*a* of sub-speaker unit container 223 which contains sub-speaker unit 26A. Protector 271A corresponds to protection member of sub-speaker unit 26A.

As examples illustrated in FIG. 5 and FIG. 6E, protector 271A is a convex member that has a plurality of slits 271*a* formed therein (see FIG. 6D). Sound output section 223*a* is formed so as to allow a diaphragm (not illustrated) of sub-speaker unit 26A to be viewed from the outside.

More specifically, protector 271A has a circular slit formed therein, and three slits having substantially the same (sectoral) shape and formed concentrically so as to surround the above circular slit. Hereinafter, these slits are collectively referred to as slits 271*a*. In short, protector 271A includes two torus plates having different sizes. These torus plates are disposed in substantially mutually different plane and interconnected via three elongated bridge parts extending in a radial direction. The three elongated bride parts are disposed at substantially regular angles. The size of protector 271A depends on the size of a diaphragm (not illustrated), which is a component of sub-speaker unit 26A.

[1-2-5. Main Speaker Unit]

Main speaker unit 23A is a dynamic type of speaker unit and can reproduce sound in the frequency band ranging from 4 Hz to 50 kHz, for example. Main speaker unit 23A has a diameter of 50 mm, for example, and is mounted in housing 22A, which is disposed over the user's left ear when the user wears headphone 1.

Main speaker unit 23B mounted in housing 22B to be disposed over the user's right ear has substantially the same configuration as main speaker unit 23A, except for main speaker unit 23B having no connector 40.

Figure 7:
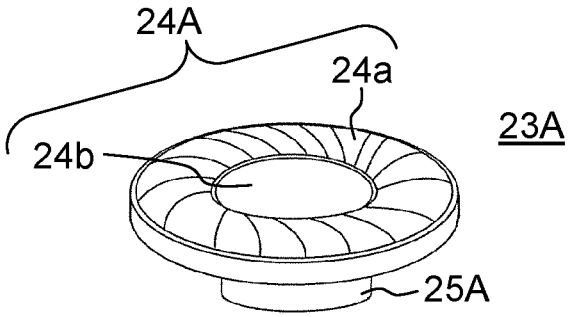
FIG. 7 is a perspective view schematically illustrating an exemplary configuration of one main speaker unit in the first exemplary embodiment.

FIG. 7 is a perspective view schematically illustrating an exemplary configuration of main speaker unit 23A in the first exemplary embodiment.

As an example illustrated in FIG. 7, main speaker unit 23A includes diaphragm 24A, a voice coil (not illustrated), and magnetic member 25A. When drive current flows through the voice coil in main speaker unit 23A in accordance with an audio signal transmitted from an audio signal reproducing apparatus, the voice coil vibrates. In response to the vibration of the voice coil, diaphragm 24A vibrates. The vibration of diaphragm 24A causes main speaker unit 23A to reproduce sound in accordance with the audio signal.

As an example illustrated in FIG. 7, diaphragm 24A is made of a flat film, whose outline is substantially circular. Diaphragm 24A is formed by joining vibrating section 24*b* to circumferential part 24*a* at its center; circumferential part 24*a* is formed into a semi-torus shape (a shape by cutting a hollow torus member along a plane perpendicular to the rotational axis), and vibrating section 24*b* has a hemispherical, conchoidal shape. Both circumferential part 24*a* and vibrating section 24*b* protrude in the same direction.

In the present disclosure, the surface of diaphragm 24A which is defined by the outline of vibrating section 24*b* (plane including the outline of vibrating section 24*b*) corresponds to the main plane of diaphragm 24A. The main plane of diaphragm 24A may be substantially perpendicular to the axis of circumferential part 24*a* or the axis of vibrating section 24*b*. In this case, the axis of circumferential part 24*a* passes through substantially the center of circumferential part 24*a* and is substantially perpendicular to circumferential part 24*a*. The axis of vibrating section 24*b* passes through substantially the center of vibrating section 24*b* and is substantially perpendicular to vibrating section 24*b*. In this exemplary embodiment, circumferential part 24*a* and vibrating section 24*b* are constituted so that the axis of circumferential part 24*a* substantially coincides with the axis of vibrating section 24*b*.

In this exemplary embodiment, the main plane of diaphragm 24A substantially corresponds to the main plane of main speaker unit 23A. The main plane of main speaker unit 23A may intersect at least a part of members constituting main speaker unit 23A, and may be a surface that is substantially perpendicular to the axis of circumferential part 24*a* or the axis of vibrating section 24*b* in diaphragm 24A.

Figure 8:
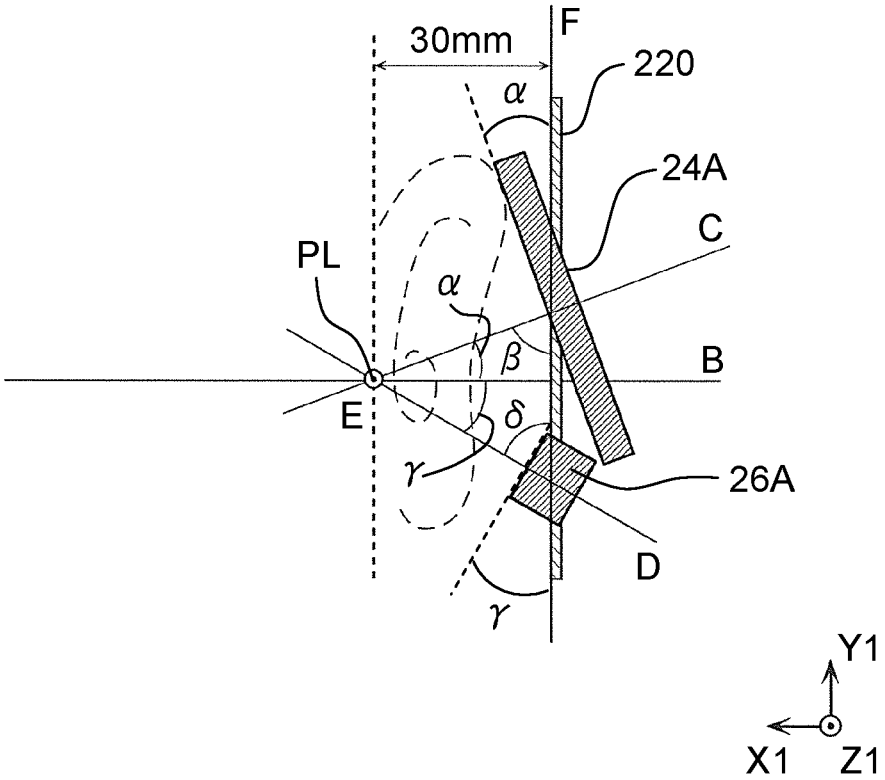
FIG. 8 is a front elevation view schematically illustrating exemplary placement of the diaphragm in the main speaker unit and the sub-speaker unit in the first exemplary embodiment.

FIG. 8 is a front elevation view schematically illustrating exemplary placement of diaphragm 24A in main speaker unit 23A and sub-speaker unit 26A in the first exemplary embodiment. FIG. 8 schematically illustrates the cross section in FIG. 6D in a simplistic form. FIG. 8 schematically illustrates the placement of flat part 220, diaphragm 24A, and sub-speaker unit 26A when the user wears headphone 1, as viewed from the user's face. In FIG. 8, the user's ear is depicted by a dotted line for the sake of expediency. It should be noted that the schematic view in FIG. 8 is used only to explain the arrangement (e.g., angles) of the individual members. So, the scales and angles of the user's ear, flat part 220, diaphragm 24A, and sub-speaker unit 26A in FIG. 8 may be different from actual scales and angles.

To explain the arrangement in FIG. 8, first axis B, second axis E, third axis F, main axis C, and main axis D are used. First axis B, second axis E, third axis F, main axis C, and main axis D are defined as follows.

First axis B is an axis connecting two reference points that are estimated to be the locations of the user's tympanic membranes, as described with reference to FIG. 6A to FIG. 6E. First axis B is parallel to axis X1. It should be noted that in FIG. 8, reference point PL, which is estimated to be the location of the tympanic membrane of the user's left ear, is illustrated, but no reference point estimated to be the location of the tympanic membrane of the user's right ear is illustrated.

Second axis E is an axis that intersects first axis B and is parallel to axis Z1. In other words, second axis E is an axis that is substantially parallel to a lateral direction of the user's pinna or to a front-back direction of the user's head.

Third axis F is an axis that extends along the main plane of baffle plate 21A (the surface of flat part 220 which is closer to the user's ear) and is substantially parallel to a longitudinal direction of the pinna (axis Y1).

Main axis C corresponds to the main axis of main speaker unit 23A and to the main axis of diaphragm 24A. The main axis of diaphragm 24A is an axis that passes through substantially the center of diaphragm 24A and is substantially perpendicular to the main plane of diaphragm 24A. The main axis of main speaker unit 23A is an axis that passes through substantially the center of main speaker unit 23A and is substantially perpendicular to the main plane of main speaker unit 23A. In this exemplary embodiment, main speaker unit 23A is formed with its main axis substantially coinciding with the main axis of diaphragm 24A. Diaphragm 24A is formed with main axis C substantially coinciding with the axis of circumferential part 24*a* having a funnel-like shape, which is a component of diaphragm 24A. In this exemplary embodiment, main speaker unit 23A is mounted in speaker casing 20A with main axis C passing through reference point PL.

Main axis D corresponds to the main axis of sub-speaker unit 26A and to the main axis of the diaphragm (not illustrated) of sub-speaker unit 26A. The main axis of the diaphragm of sub-speaker unit 26A is an axis that passes through substantially the center of the diaphragm of sub-speaker unit 26A and is substantially perpendicular to the main plane of the diaphragm of sub-speaker unit 26A. The main axis of sub-speaker unit 26A is an axis that passes through substantially the center of sub-speaker unit 26A and is substantially perpendicular to the main plane of sub-speaker unit 26A. In this exemplary embodiment, sub-speaker unit 26A is formed with its main axis substantially coinciding with the main axis of the diaphragm of sub-speaker unit 26A. In this exemplary embodiment, sub-speaker unit 26A is mounted in speaker casing 20A with main axis D passing through reference point PL.

In this exemplary embodiment, main speaker unit 23A is inclined toward the user's ear lobe, so that the main plane of main speaker unit 23A (i.e., the main plane of diaphragm 24A) faces the tympanic membrane of the user wearing headphone 1 (i.e., reference point PL). In this case, main speaker unit 23A is attached to speaker casing 20A such that the main plane of main speaker unit 23A (the main plane of diaphragm 24A) forms angle $\alpha$ ranging from 10° to 30° (20°±10°) inclusive with the main plane of baffle plate 21A (i.e., the surface of flat part 220 which is closer to the user's ear or the plane on third axis F in FIG. 8), which is an example of the support member. Angle $\alpha$ is determined based on an experiment that has been conducted to decrease an average location error.

As described above, the main plane of main speaker unit 23A substantially coincide with the main plane of diaphragm 24A. Hence, the above configuration can also be expressed as follows. Main axis C of diaphragm 24A is inclined at angle $\beta$ ranging from 60° to 80° (70°±10°) inclusive with respect to the main plane of baffle plate 21A (the third axis F in FIG. 8).

The above configuration can also be expressed as follows. Main speaker unit 23A is mounted in speaker casing 20A such that main axis C of diaphragm 24A is inclined at angle $\alpha$ ranging from 10° to 30° (20°±10°) inclusive with respect to first axis B.

The above configuration can also be expressed as follows. Baffle plate 21A, which is an example of the support member, supports main speaker unit 23A so as to be rotated around second axis E in the direction from first axis B to the top of the user's head, so that the main axis of main speaker unit 23A passes through reference point PL and is inclined at angle $\alpha$ ranging from 10° to 30° (20°±10°) inclusive with respect to first axis B.

[1-2-6. Sub-Speaker Unit]

Sub-speaker unit 26A is a dynamic type of speaker unit and can reproduce sound in a frequency band, such as a frequency band ranging from 50 kHz to 100 kHz, that is different from the frequency band of main speaker unit 23A. Sub-speaker unit 26A is a speaker unit mounted in housing 22A, which is disposed over the user's left ear when the user wears headphone 1.

Sub-speaker unit 26B (not illustrated) mounted in housing 22B to be disposed over the user's right ear has substantially the same configuration as sub-speaker unit 26A.

As an example illustrated in FIG. 6E, sub-speaker unit 26A is disposed on baffle plate 21A below main speaker unit 23A (close to the user's chin when the user wears headphone 1) and close to the front portion of the head with respect to central line A (close to the user's face when the user wears headphone 1). Sub-speaker unit 26A is thereby positioned in speaker casing 20A so as not to interfere with main speaker unit 23A.

As illustrated in FIG. 8, sub-speaker unit 26A is mounted in speaker casing 20A with main axis D intersecting main axis C of main speaker unit 23A at reference point PL. As described above, main axis D of sub-speaker unit 26A coincides with the main axis of the diaphragm (not illustrated) of sub-speaker unit 26A. The diaphragm of sub-speaker unit 26A has a smaller size than diaphragm 24A of main speaker unit 23A, but both shapes are substantially the same as each other.

In this exemplary embodiment, sub-speaker unit 26A is inclined toward the top of the user's head, so that the main plane of sub-speaker unit 26A (i.e., the main plane of the diaphragm of sub-speaker unit 26A) faces the tympanic membrane of the user wearing headphone 1 (i.e., reference point PL). In this case, sub-speaker unit 26A is mounted in speaker casing 20A such that main axis D of sub-speaker unit 26A is inclined at angle $\gamma$ ranging from 30° to 50° (40°±10°) with respect to first axis B. Angle $\gamma$ is determined based on an experiment that has been conducted to decrease an average location error.

The above configuration can also be expressed as follows. Main axis D of sub-speaker unit 26A is inclined at angle $\delta$ ranging from 40° to 60° (50°±10°) with respect to the main plane of baffle plate 21A (third axis F in FIG. 8).

The above configuration can also be expressed as follows. Sub-speaker unit 26A is rotated at angle $\gamma$ ranging from 30° to 50° (40°±10°) around second axis E in the direction from first axis B to the ear lobe.

The above configuration can also be expressed as follows. Baffle plate 21A, which is an example of the support member, supports sub-speaker unit 26A so as to be rotated around second axis E in the direction from the first axis B to the user's ear lobe, so that the main axis of sub-speaker unit 26A passes through reference point PL and is inclined at angle $\gamma$ ranging from 30° to 50° (40°±10°) inclusive with respect to first axis B.

[1-2-7. Plug]

Plug 40 is a member via which a cord for transmitting audio signals output from an audio signal reproducing apparatus to headphone 1 is connected to headphone 1. In this exemplary embodiment, plug 40 is provided in housing 22A.

[2. Modification]

Figure 9:
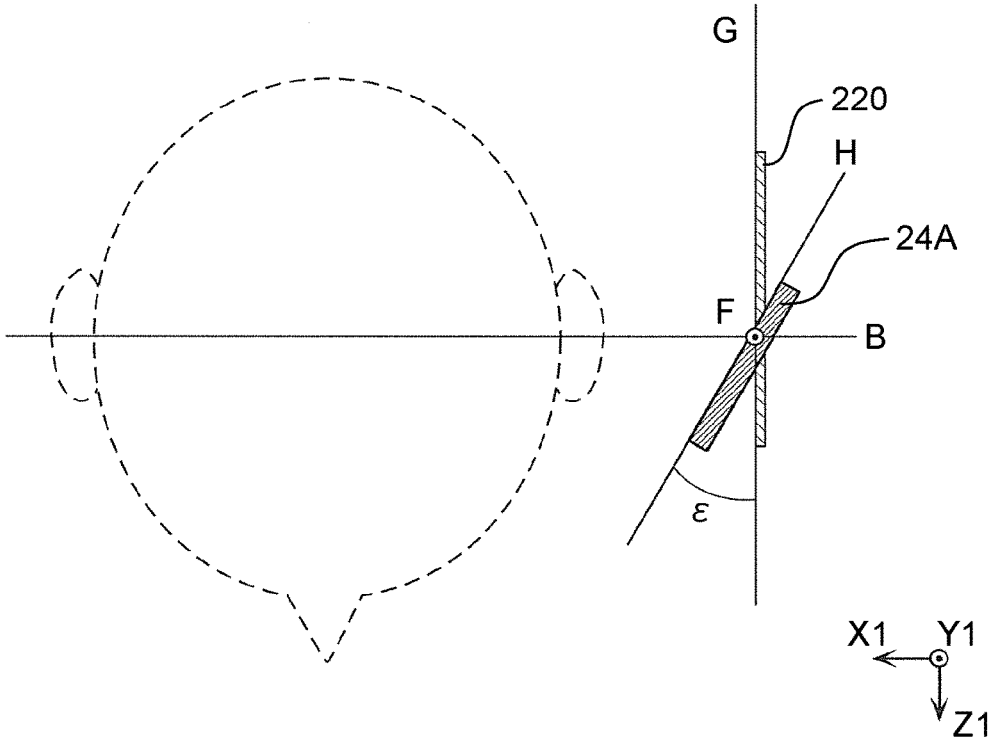
FIG. 9 is a top view schematically illustrating exemplary placement of the diaphragm in the main speaker unit and the sub-speaker unit in the first exemplary embodiment.

FIG. 9 is a top view schematically illustrating exemplary placement of diaphragm 24A in main speaker unit 23A and sub-speaker unit 26A in the first exemplary embodiment. FIG. 9 schematically illustrates placement of diaphragm 24A in a simplistic form.

In FIG. 9, axis G is an axis on the X1Z1 plane, which extends along the main plane of baffle plate 21A (the surface of flat part 220 which is closer to the ear). In addition, axis G is substantially orthogonal to third axis F in FIG. 8 and substantially parallel to axis Z1. Axis H is an axis on the X1Z1 plane across the main plane of diaphragm 24A. In addition, axis H is substantially orthogonal to third axis F in FIG. 8.

FIG. 9 schematically illustrates the placement of flat part 220 and diaphragm 24A when the user wears headphone 1, as viewed from the top of the user's head. In FIG. 9, the user's head is depicted by a dotted line for the sake of expediency. It should be noted that the schematic view in FIG. 9 is used only to explain the arrangement (e.g., angles) of the individual members. Thus, the scales and angles of the user's head, flat part 220, and diaphragm 24A in FIG. 9 may be different from actual scales and angles.

In the first exemplary embodiment, an exemplary configuration that diaphragm 24A (i.e., main speaker unit 23A) is rotated around second axis E has been described; however, diaphragm 24A may be further rotated around third axis F.

In this exemplary configuration, diaphragm 24A (main speaker unit 23A) is rotated around third axis F as a rotational axis. As a result, one edge of diaphragm 24A which is closer to the user's face moves toward the user's face, whereas the other edge of diaphragm 24A which is closer to the back portion of the user's head moves away from the back portion of the user's head. In this case, axis H may be inclined at angle $\epsilon$ of approximately 7°, for example, with respect to axis G. It should be noted that angle $\epsilon$ exceeds 7° in FIG. 9, because the arrangement of flat part 220 and diaphragm 24A is exaggerated for the purpose of helping a visual understanding.

Angle $\epsilon$ of axis H with respect to axis G is preferably set in the range from approximately 0° to 15° in accordance with the angle of the user's pinna (the angle between the temporal region and the pinna).

Similar to diaphragm 24A, sub-speaker unit 26A may be rotated around third axis F.

[3. Function and Effect]

According to an exemplary embodiment of the present disclosure, a headphone includes a speaker casing and a headband. The speaker casing has a main speaker unit and a support member that supports the main speaker unit. The headband is connected to the speaker casing and is to be placed on a head of a user. The support member supports the main speaker unit with a main plane of the main speaker unit being positioned at an angle ranging from 10° to 30° inclusive with respect to a main plane of the support member, so that the main plane of the main speaker unit faces an ear lobe of the user.

According to another exemplary embodiment of the present disclosure, a headphone includes a speaker casing and a headband. The speaker casing has a main speaker unit and a support member that supports the main speaker unit. The headband is connected to the speaker casing and is to be placed on a head of a user. In the headphone, two points estimated to be locations of two tympanic membranes of the user are set as two reference points, and an axis connecting the two reference points is set as a first axis. An axis that passes through the reference point, is perpendicular to the first axis, and is parallel to a front-back direction of the head of the user is set as a second axis. The support member supports the main speaker unit so as to be rotated around the second axis in a direction from the first axis to a top of the head of the user, so that a main axis of the main speaker unit passes through the reference point and is inclined at an angle ranging from 10° to 30° inclusive with respect to the first axis.

Headphone 1 is an example of the above headphones. Each of speaker casing 20A and speaker casing 20B is an example of the above speaker casings. Headband 10 is an example of the above headbands. Each of main speaker unit 23A and main speaker unit 23B is an example of the above main speaker units. Each of housing 22A, housing 22B, baffle plate 21A, and baffle plate 21B is an example of the above support members. Reference point PL is an example of the above reference points. First axis B is an example of the above first axis. Second axis E is an example of the above second axis.

In each headphone, the main speaker unit may have a diaphragm. The support member may support the main speaker unit so that a main axis of the diaphragm is positioned at an angle ranging from 60° to 80° inclusive with respect to the main plane of the support member.

Diaphragm 24A is an example of the above diaphragm.

In the foregoing first exemplary embodiment and modification, baffle plate 21A supports main speaker unit 23A with the main plane of main speaker unit 23A is positioned at angle $\alpha$ ranging from 20°±10° (10° to 30°) inclusive with respect to the main plane of baffle plate 21A (an example of the main plane of the support member), so that the main plane of the main speaker unit 23A faces the user's ear lobe when the user wears headphone 1.

More specifically, in the foregoing first exemplary embodiment and modification, baffle plate 21A supports main speaker unit 23A so that main axis C of diaphragm 24A is positioned at angle $\beta$ ranging from 70°±10° (60° to 80°) inclusive with respect to the main plane of baffle plate 21A.

In other words, baffle plate 21A supports main speaker unit 23A so as to be rotated around second axis E in the direction from first axis B to the top of the user's head, so that the main axis of main speaker unit 23A (main axis C of diaphragm 24A) passes through reference point PL and is inclined at angle $\alpha$ ranging from 20°±10° (10° to 30°) inclusive with respect to first axis B.

Headphone 1 configured above enables sound emitted from main speaker unit 23A to be output from an orientation in which an average location error decreases to a user's tympanic membrane. Thus, quality of sound (enhanced presence) heard by the user wearing headphone 1 can be improved, in comparison with headphones in which a diaphragm is rotated at an angle of 0° around second axis E. Consequently, headphone 1 can produce high-quality stereo sound.

In each headphone, the support member may be a baffle plate on which the main speaker unit is mounted.

Each of baffle plate 21A and baffle plate 21B may be an example of the above baffle plate.

In the foregoing first exemplary embodiment and modification, for example baffle plate 21A functions as the support member.

Each headphone may further include a sub-speaker unit. The support member may support both the main speaker unit and the sub-speaker unit in an inclined position respectively so that the main axis of the main speaker unit intersects a main axis of the sub-speaker unit at a predetermined reference point.

In each headphone, a point estimated to be a location of a tympanic membrane of the user may be set as the reference point.

Each of sub-speaker unit 26A and sub-speaker unit 26B is an example of the above sub-speaker unit. Reference point PL is an example of the above reference point.

In the foregoing first exemplary embodiment and modification, for example speaker casing 20A has sub-speaker unit 26A. Speaker casing 20A is configured such that main axis D of sub-speaker unit 26A intersects main axis C of main speaker unit 23A at a predetermined reference point.

With the above configuration, speaker casing 20A can cause sub-speaker unit 26A to output sound toward the predetermined reference point, more specifically toward a site estimated to be the location of the user's tympanic membrane. Therefore, headphone 1 configured above can improve, with respect to sound which is heard by the user wearing headphone 1, quality of the sound (enhanced presence) from not only main speaker unit 23A but also sub-speaker unit 26A.

In each headphone, the support member may support the sub-speaker unit so as to be positioned on a front side of the head of the user with respect to a central line of a baffle plate on which the main speaker unit is mounted or with respect to a central line of a protector that covers an opening of the baffle plate. The central line of the baffle plate or the central line of protector may be parallel to a longitudinal direction of a pinna of the user.

Each of protector 27A and protector 27B is an example of the above protector.

In the foregoing first exemplary embodiment and modification, for example sub-speaker unit 26A is positioned on the front side of the user's head with respect to central line A of baffle plate 21A (which passes through substantially the center of baffle plate 21A and is substantially parallel to a longitudinal direction of the user's pinna).

With the above configuration, sub-speaker unit 26A can be positioned in speaker casing 20A so as not to interfere with main speaker unit 23A.

Other Exemplary Embodiments

Up to this point, the first exemplary embodiment and the modification have been described as examples of the technique disclosed in this application. However, the techniques in the present disclosure are not limited to the first exemplary embodiment and the modification and are applicable to exemplary embodiments that undergo various modifications, substitutions, additions, omissions, and the like. Alternatively, novel exemplary embodiments may be conceived of from a combination of some components described in the first exemplary embodiment and the modification.

Other exemplary embodiments will be described below.

The following description will be focused on speaker casing 20A; however, this description is also applicable to speaker casing 20B.

In the first exemplary embodiment and the modification, an exemplary configuration that main speaker unit 23A is attached to baffle plate 21A has been described. However, main speaker unit 23A may be attached to housing 22A, instead of baffle plate 21A. In this exemplary embodiment, housing 22A corresponds to the support member, and the main plane of housing 22A corresponds to the main plane of the support member. The main plane of housing 22A corresponds to, for example, a plane containing the opening of housing 22A (the surface of baffle plate 21A which is parallel to the surface of flat part 220); however, the main plane of housing 22A is not limited thereto. The main plane of housing 22A may be any surface which is parallel to the plane containing the opening of housing 22A.

In the first exemplary embodiment and the modification, an exemplary configuration that speaker casing 20A is provided with sub-speaker unit 26A has been described; however, sub-speaker unit 26A is not an essential component in the present disclosure. So, speaker casing 20A does not necessarily have to be provided with sub-speaker unit 26A.

Speaker casing 20A may include a plurality of sub-speaker units 26A. If speaker casing 20A includes a plurality of sub-speaker units 26A, a plurality of sub-speaker units 26A may be arranged so that each of the main axes of the plurality of sub-speaker units 26A intersects the main axis of main speaker unit 23A at corresponding reference points PL.

In the first exemplary embodiment and the modification, an exemplary configuration that both main speaker unit 23A and sub-speaker unit 26A are dynamic types of speaker units has been described; however, the types of main speaker unit 23A and sub-speaker unit 26A are not limited thereto. Main speaker unit 23A and sub-speaker unit 26A may be arbitrary types of speaker units. Furthermore, main speaker unit 23A and sub-speaker unit 26A may be different types of speaker units from each other.

In the first exemplary embodiment and the modification, an exemplary configuration that headphone 1 is connected to another apparatus via a cord for transmitting audio signals (not illustrated) has been described. However, headphone 1 may be wirelessly connected to another apparatus.

The position-related words "over", "below", "right", "left", "front", "back", and the like used in the first exemplary embodiment and the modification indicate relative positions, for the sake of expediency. So, these words are not intended to indicate absolute positions. The word "center" used in the first exemplary embodiment and the modification may indicate a barycenter or the intersection point of the major and minor axes of an ellipse. Alternatively, the word "center" may indicate a point conforming to any other definitions. The words "center", "perpendicular", and "parallel" used in the first exemplary embodiment and the modification should not be interpreted strictly. So, some errors should be permitted unless the errors inhibit the object to be achieved.

Up to this point, the exemplary embodiments and modifications have been described as examples of the techniques of the present disclosure. For that purpose, the accompanying drawings and the detailed description have been given.

It should be noted that not all the components described in the accompanying drawings and the detailed description are essential to solve the disadvantages. So, some unessential components are used for the purpose of helping understand the above technique. For this reason, components described in the accompanying drawings and the detailed description should not always be perceived as being essential.

The foregoing exemplary embodiments and modifications describe examples of the technique in the present disclosure. Therefore, the exemplary embodiments and modifications can undergo various modifications, substitutions, additions, omissions, and the like within the scopes of the claims and their equivalents.

INDUSTRIAL APPLICABILITY

The present disclosure is applicable to headphones to be connected to apparatuses having audio signal output functions such as audio players, TVs, and the like.

REFERENCE MARKS IN THE DRAWINGS

1 headphone
10 headband
20A, 20B speaker casing
21A, 21B baffle plate
22A, 22B housing
23A, 23B main speaker unit
24A diaphragm
25A magnetic member
26A, 26B sub-speaker unit
27A, 27B, 271A, 271B protector
27*a*, 271*a* slit
30A, 30B ear pad
201A groove
220 flat part
221 fixing section
222 main speaker unit container
222*a*, 223*a* sound output section
222*c*, 223*c* slope
223 sub-speaker unit container
301A engaging section
A central line
B first axis
C, D main axis
E second axis
F third axis
G, H, X1, Y1, Z1 axis

The invention claimed is:

1. A headphone comprising:

a speaker casing including a main speaker unit, a sub-speaker unit and a support member that supports the main speaker unit and the sub-speaker unit; and a headband that is connected to the speaker casing and is to be placed on a head of a user, wherein:

the support member supports the main speaker unit with a main plane of the main speaker unit being positioned at an angle ranging from 10° to 30° inclusive with respect to a main plane of the support member, so that the main plane of the main speaker unit faces an ear lobe of the user, and the support member support the sub-speaker unit with a main plane of the sub-speaker unit being positioned at an angle ranging from 30° to 50° inclusive with respect to the main plane of the support member, so that the main plane of the sub-speaker unit faces an ear lobe of the user.

2. The headphone according to claim 1, wherein the main speaker unit has a diaphragm, and the support member supports the main speaker unit with a main axis of the diaphragm being positioned at an angle ranging from 60° to 80° inclusive with respect to the main plane of the support member.

3. The headphone according to claim 1, wherein the support member is a baffle plate on which the main speaker unit is mounted.

4. The headphone according to claim 1, wherein the support member supports both the main speaker unit and the sub-speaker unit in an inclined position respectively so that the main axis of the main speaker unit intersects a main axis of the sub-speaker unit at a predetermined reference point.

5. The headphone according to claim 4, wherein a point estimated to be a location of a tympanic membrane of the user is set as the reference point.

6. The headphone according to claim 4, wherein the support member supports the sub-speaker unit so as to be positioned on a front side of the head of the user with respect to a central line of a baffle plate on which the main speaker unit is mounted or with respect to a central line of a protector that covers an opening of the baffle plate, and the central line of the baffle plate or the central line of the protector is parallel to a longitudinal direction of a pinna of the user.

7. A headphone comprising:

a speaker casing including a main speaker unit, a sub-speaker unit and a support member that supports the main speaker unit and the sub-speaker unit; and a headband that is connected to the speaker casing and is to be placed on a head of a user, wherein two points estimated to be locations of two tympanic membranes of the user are set as two reference points, and an axis connecting the two reference points is set as a first axis, wherein an axis that passes through the reference point, is perpendicular to the first axis, and is parallel to a front-back direction of the head of the user is set as a second axis, wherein the support member supports the main speaker unit so as to be rotated around the second axis in a direction from the first axis to a top of the head of the user, so that a main axis of the main speaker unit passes through the reference point and is inclined at an angle ranging from 10° to 30° inclusive with respect to the first axis, and wherein the support member support the sub-speaker unit such that a main axis of the sub-speaker unit passes through the reference point and is inclined at an angle ranging from 30° to 50° inclusive with respect to the first axis.

* * * * *